United States Patent [19]

Johnson

[11] Patent Number: 4,914,757

[45] Date of Patent: Apr. 10, 1990

[54] AUTOMATIC TOILET LID/SEAT CONTROL DEVICE

[76] Inventor: Oriz W. Johnson, 7086 Butterwood Dr., Cincinnati, Ohio 45241

[21] Appl. No.: 294,105

[22] Filed: Jan. 6, 1989

[51] Int. Cl.[4] ..... E03D 9/02; A47K 13/10; F16F 9/14

[52] U.S. Cl. ..... 4/224; 4/251; 188/309; 188/310

[58] Field of Search ..... 4/251, 223, 224; 188/308, 309, 310

[56] References Cited

U.S. PATENT DOCUMENTS

| | | | |
|---|---|---|---|
| 2,692,394 | 10/1954 | Paulus | 4/251 |
| 3,178,070 | 4/1965 | Leland | 4/223 |
| 3,336,603 | 8/1967 | Leland | 4/223 |
| 3,613,842 | 10/1971 | Buciak | 188/306 |
| 3,698,521 | 10/1972 | Taylor | 188/306 |
| 4,491,989 | 1/1985 | McGrail | 4/251 |
| 4,670,916 | 6/1987 | Bloom | 4/231 |
| 4,736,740 | 4/1988 | Classon | 4/222 |
| 4,825,503 | 5/1989 | Shiramasa et al. | 16/52 |

FOREIGN PATENT DOCUMENTS

| | | | |
|---|---|---|---|
| 367888 | 7/1931 | United Kingdom | 188/310 |
| 1096114 | 12/1967 | United Kingdom | 4/223 |

*Primary Examiner*—Henry J. Recla
*Assistant Examiner*—R. M. Fetsuga

[57] ABSTRACT

A retrofit accessory to be installed by the layman to a domestic toilet, which locks the lid, or lid and seat, in the upright position while in use, and automatically lowers them gently when flushed. Additionally, the accessory to automatically dispense toilet bowl cleaner and/or deodorant spray and to lock the lid in the closed position when desired.

10 Claims, 5 Drawing Sheets

AUTOMATIC TOILET LID/SEAT CONTROL DEVICE

SUMMARY OF THE INVENTION

The present invention has as its first philosophical objective the elimination of the inconvenience, trauma, possible injury, and the understandable irritation of any female who might use a toilet in the dark thinking the seat is down when it is not.

A second and most fundamental philosophical objective of the invention is to encompass in a single, self-contained system, all of the functional objectives itemized below and in a fashion that is so adaptable to the conventional toilet seat hinge mechanism and variations as to be virtually universal. Moreover, that even a layman might easily install the system using the simplest of hand tools, generally only a screw driver.

A third philosophical objective, not far removed from the second, but essential in its own right, is that the system provide the functional objectives itemized below, and to do so in a fashion that can be produced at a price the general public can in fact afford.

As to functional objectives, the first is to provide for the retention jointly of the toilet seat and lid in the upright position while in use, and to then cause them to automatically and gently descent after use, to wit, when flushed.

Another objective is that the system allow, independent of the seat, the manual raising, and automatic retention and lowering after use, of the lid for aesthetic or hygienic reasons.

Another objective is to provide for an override of the control mechanism such that the toilet lid or seat if desired, may be raised or lowered manually at any time.

Another objective is to provide a unique hinged and sliding-interlock linkage to enable the layman to install the control device on a wide range of existing seat hinge arrangements without need to intrically align the centerlines of the various rotating components.

Another objective is to provide means of adjusting the lid-descent time to the wide range of lid and seat weights, ranging from featherweight foam plastic to solid oak, presently found on existing seat assemblies. Further, so as reduce stress on the descent control mechanism, to provide a seat-weight compensator to offset the heavier assemblies.

Another objective is to provide for the optional means of integrating the automatic dispensing of toilet bowl cleaner fluid into the operation of the toilet lid/-seat control mechanism.

Another objective is to provide for the optional means of integrating the automatic dispensing of deodorant/disinfectant spray into the operation of the toilet lid/seat control mechanism.

Lastly, an important objective for parents and grand parents of very young children, a device for automatically, or manually, locking the toilet lid in the closed position for hygiene and safety.

DESCRIPTION OF THE DRAWINGS

Referring to the accompanying drawings, which are for illustrative purposes only.

DESCRIPTION OF THE PREFERRED EMBODIMENT

As will become evident, the preferred embodiment is somewhat pluralistic, as it encompasses as many variables as are necessary to enable the invention to fill its role as a layman's retrofit system, i.e. capable of self modification to fit virtually any existing conventional toilet lid/seat assembly and to provide for the several other functions intended.

The preferred embodiment is presented in its simplest geometry for illustrative purposes, devoid of rib configurations required to insure structural integrity for the loads incurred and to be capable of high speed injection molding.

Figure 1:
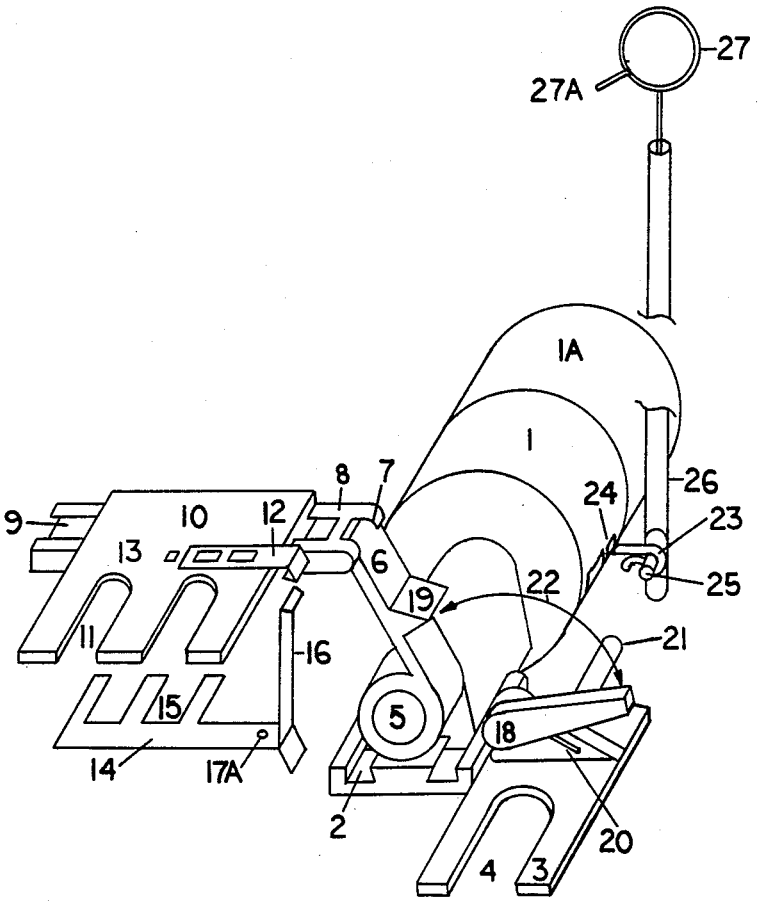
FIG. 1 is a cabinet oblique perspective view of the device in its entirety, save for optional fixtures shown in FIGS. 4, 7, 8 and 9.

Referring to FIG. 1

A lid-control cylindrical housing, 1 and 1A, about the size of a D-cell battery is attached, via sliding interlock 2 to toilet seat attachment bracket 3. Said interlock enables the cylinder assembly to slide forward or back to accomodate out-of-norm toilet seat hinge configurations.

Attachment bracket 3 is fixedly attached to the toilet bowl by loosening the left mounting bolt of any existing toilet seat hinge assembly (not shown), sliding the bracket under the assembly such that slot 4 accomodates the mounting bolt and re-tightening the bolt, securely capturing the bracket against the bowl.

The toilet accessory is attached to the lid itself by fixedly attaching lid control arm 6 to the end of rotatable lid control shaft 5, and via a hinged union 7, to member 8. Member 8 is engaged in turn to lid bracket 10 via a sliding interlock 9. Member 8 may slide along lid bracket 10 to assume various juxtapositions as explained later in FIG. 6.

Lid bracket 10 is fixedly attached to the lid by loosening the existing lid hinge arm screws, (not shown) sliding the bracket under the arm such that the slots 11 accomodate the screws, and retightening the screws securely capturing the lid bracket against the underside of the lid.

Additionally lid member 12 of the seat coupler, made of spring steel, is likewise captured between lid bracket 10 and the lid. Male and female dimples 13 in members 10 and 12 enable member 12 to be fixedly re-positioned as desired against member 10 before the lid screws are re-tightened. (The virtue of re-positioning member 12 is explained later in FIG. 5D.)

The seat member 14 of the lid/seat coupler, also made of spring steel, is fixedly attached to the toilet seat by loosening the existing seat-hinge arm screws (not shown), sliding the seat member 14 under the arm such that slots 15 accomodate the screws and retightening the screws securely capturing the seat member 14 against the bottom of the seat. Seat member arm 16, past the edge of the seat, extends upward to engage the lid member 12 as explained later in FIG. 5. Adjustment screw hole 17A is provided for use when required, again as explained in FIG. 5.

Lid lock arm 18 is swiveled against lockstop 19, per arrow 22, by torsion spring 20, thus automatically locking lid control arm 6 in the down position. Torsion spring 20 may be removed such that the lid may be manually locked only when desired. Finger latch 21 is provided for ease of manual lifting of the lock arm.

Lid-control shaft lock release spring 23 exits control clylinder 1 thru slot 24 and snaps onto hinge post 25 of the flush rod 26. The flush rod, in turn, is attached to existing toilet flush handles (not shown) by squeezing leg 27A to enlarge spring 27 which is then passed over the end of the flush handle and released to tighten on the handle. The other leg of spring 27 is inserted into a lengthwise bore of the flush rod 26 via friction fit. (Flush rod length may be altered by simply removing spring 27, cutting off the excess length of the plastic rod with a knife and re-inserting the spring leg into the bore.)

Figures 2, 3:
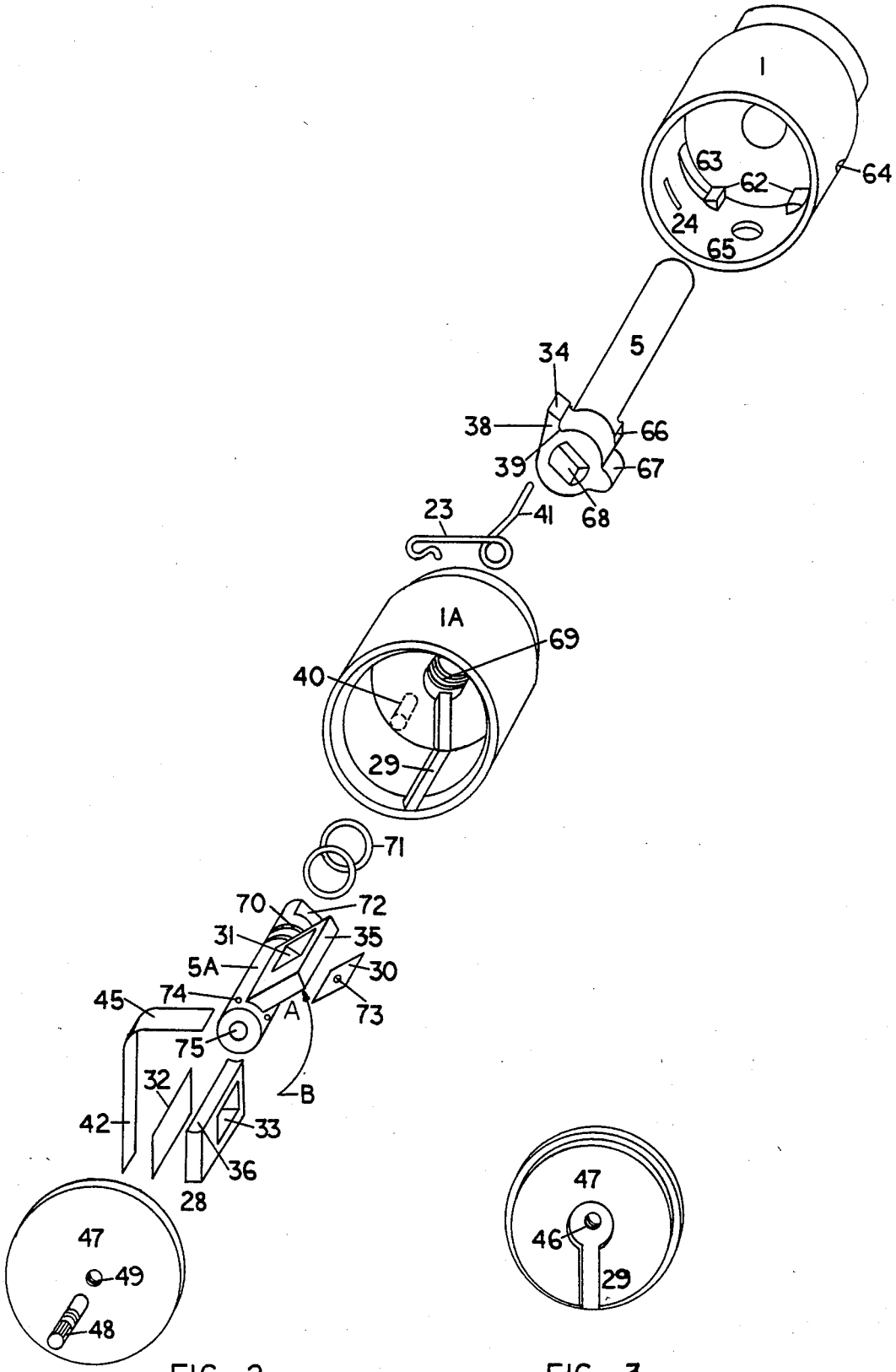
FIG. 2 is an exploded perspective view of the lid control cylinder, internal parts and lid-control shaft.
FIG. 3 is a perspective view of the lid control cylinder end-cap reversed to reveal anchor channels.

Referring to FIG. 2:

Fixed pressure barrier 28 is inserted in liquid-filled pressure vessel 1A via channel 29, butting the forward end of the vessel, and locked down in place by the lid control shaft 5A inserted through the forward end of the vessel above it. The shaft and the barrier are further locked in place by channels 29 and 46 in end-cap 47, shown in FIG. 3. The shaft O-rings 71 in grooves 69 and 70 on one end and the end-cap 47 on the other completes the pressure vessel 1A

As the shaft rotates,the blade extension 35 of the shaft snugly sweeps the interior circumference and both end walls of the vessel from point A to B. The snugness of fit against these surfaces creates an essentially pressure tight chamber within the vessel between the fixed barrier 28 and the rotating blade barrier 35.

The protruding flatted forward end 72 of the lid control shaft 5A is inserted into slot 68 in lid control shaft 5, the forward end of which is fixedly attached to lid control arm 6, as previously discussed in FIG. 1, such that when the lid is in its horizontal position, blade 35 is in the down position, point B. When the toilet lid is raised, blade 35 is rotated to the point A, and flap valve 30 on port 31 is forced open by fluid pressure, allowing free flow of fluid thru the port to break any resistance to rotation.

By like measure, if the lid is forced down abruptly, causing excessive, and possibly damaging pressure within the chamber, heavy-duty flap 32 on the fixed barrier is pressed open, relieving the excess pressure thru port 33.

The snap end of torsion spring 23 is inserted thru slot 24 from inside the cylinder, the radius of the spring placed on mandrel 40 attached to the forward wall of vessel 1A, and bent leg 41 positioned to press against angular faced post 38. When the lid is raised, the angular surface 34 of the post rotates against the spring leg, depressing it back to the left until past, at which point the blade is at point A, the lid is upright, and the bent leg snaps forward to latch into slot 39, in effect locking the lid in the upright position until released.

Descent initiator spring leg 42 is affixed vertically to fixed barrier 28. The horizontal spring leg 45 is laid over shaft 5A such that the leg presses down on the top of blade 35 when the blade is in the upper position. The initiator spring biases the blade to rotate down to the right, which in turn rotates the toilet lid to the right to start its descent. After approximately 15 degrees of blade rotation, the initiator spring is relaxed and "out of the circuit".

(Brief Summary: Flushing the toilet depresses the toilet flush handle, the flush rod 26, and the snap-end of spring 23, rotating the spring around mandrel 40 and the hooked leg 41 out of slot 39 and off post 38, thus freeing blade 35, as biased by initiator spring 42, to rotate to the right, and the lid to start its descent.)

The descent of the lid is cushioned by the pressurized fluid in the chamber slowly escaping the chamber via bleed-port 73 restraining the blade as it sweeps down from its horizontal position toward the fixed pressure barrier at the bottom of the chamber. A threaded lid-descent-rate adjustment "needle valve" 48 penetrates the pressure chamber end wall at 49 and into the end of shaft 5A at 75 to control the fluid flow from high to low side thru port 74. Opening or closing this valve varies the chamber pressure release rate and, subsequently, the descent rate to match the weight of the lid, i.e. mostly closed to support heavy lids, opened somewhat to shorten the descent time of ultra-light lids.

Referring to FIG. 3

The end-cap 47 permanently inserts in the end of the pressure vessel such that it forms not only a tight seal for the pressure vessel, but also a bearing support 46 for the end of the rotating lid control shaft 5A and an end anchor slot 29 for the fixed pressure barrier 28.

Figure 4:
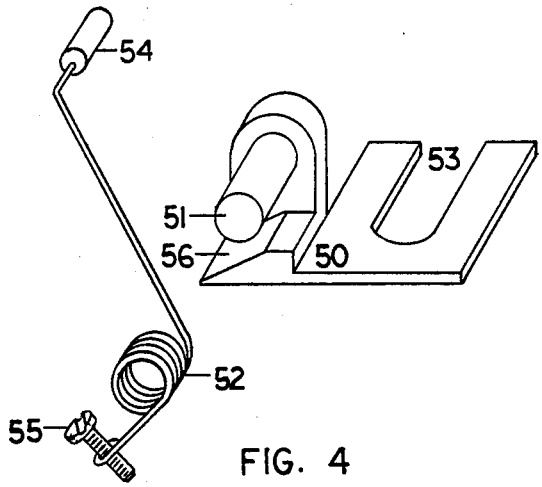
FIG. 4 is a perspective view of the optional seat-weight compensation device.

Referring to FIG. 4

Optional seat-weight compensating spring is employed only when existing toilet seat is unusually heavy, or to reduce strain on the lid control mechanism. In most instances this option will not be used.

Bracket 50 is fixedly attached to the toilet bowl by loosening the existing right seat hinge assembly mounting bolt (not shown), sliding the bracket under the assembly such that slot 53 accomodates the mounting bolt, and retightening the bolt, securely capturing the bracket against the bowl. Torsion spring 52 is inserted onto mandrel 51. Roller 54 is positioned to roll against the underside of the toilet seat as it lowers, tensing spring 52.

Adjustment screw 55 presses against land 56 and when turned, adjusts the tension of spring 52 to offset the weight of the seat as closely as possible, i.e. just enough that the spring does not quite raise the seat off the bowl when the lid is raised.

Referring to FIG. 5

This series particularly illustrates the operation of the lid/seat coupler as applied to a typical lid/seat assembly, inasmuch as the concept is unique and perhaps not readily understood on its face.

Figure 5A:
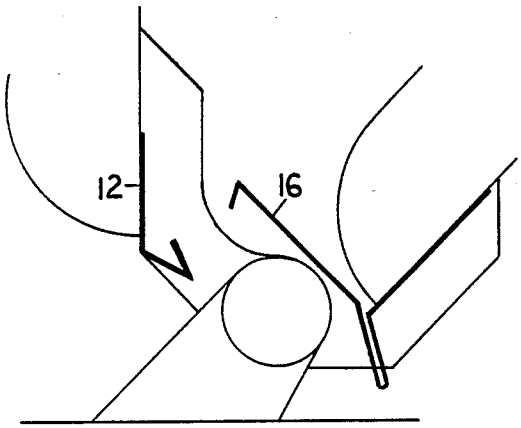
FIG. 5 is a series of symbolic elevations to demonstrate different operating modes of the lid/seat coupler.

FIG. 5A illustrates the toilet lid in the upright position and seat in a 45-degree ascending mode. Spring-steel latch arm 16 is biased to the left against the toilet seat hinge if encountered, or approximately 5 degrees to the left of vertical if not.

Figure 5B:
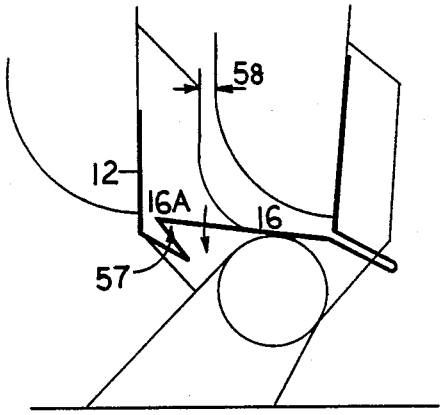

FIG. 5B As the seat is raised toward the lid, male latch 16A is guided by surface 57 of the lid member 12 back to the right, against its bias. When clear of surface 57, the latch arm snaps forward enabling male latch 16A to engage the female latch catch of member 12. Moreover, male latch remains coupled as long as the lid in in the upright position or during its decendency.

The length of latch arm 16 is intentionally excessive and a slight gap 58 exists, per weight of gravity, between the lid and seat while in the coupled descending mode.

Figure 5C:
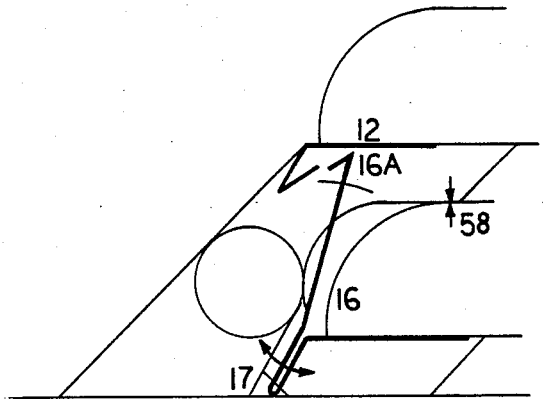

FIG. 5C As the descending lid/seat reaches horizontal, the short angular pivot leg 17 encounters the surface of the toilet bowl, which forces the pivot leg to the left and, in turn, the latch arm to the right, biasing the arm to unlatch.

When the weight of the lid settles on the seat, gap 58 closes, in effect lengthening latch arm 16 such that the right bias imposed by pivot leg 17 automatically disengages male latch 16A from lid member 12. Additionally, the latch arm remains in the disengaged right bias mode, per force of the weight of the seat, enabling the lid to be raised independent of, and without thought of, the seat.

Figure 5D:
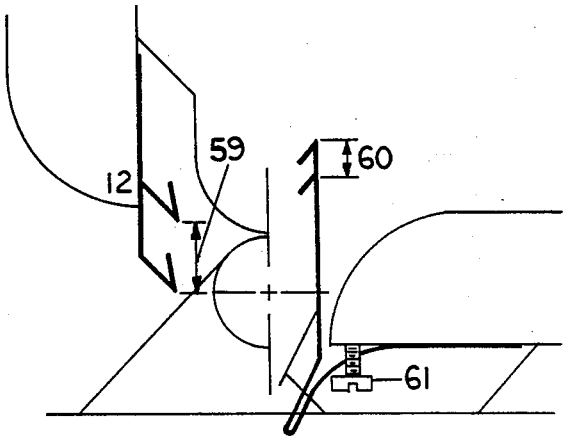

FIG. 5D Illustrates the adjustment 59 of the position of the female catch of lid member 12 to accommodate varying hinge radii or differing seat geometry that might be encountered in actual application. The lid member is positioned via male and female dimples before the lid screws are retightened, as described in FIG. 1.

An additional adjustment 60 may be made, if required, by inserting and turning adjustment screw 61 in screw hole 17a provided for that purpose, per FIG. 1.

The inherent flexibility of spring steel components strategically throughout allows the invention to be applied without modification to most brands of toilet seats. The additional value of the two adjustments discussed above, however, makes the application virtually universal.

Figure 6A:
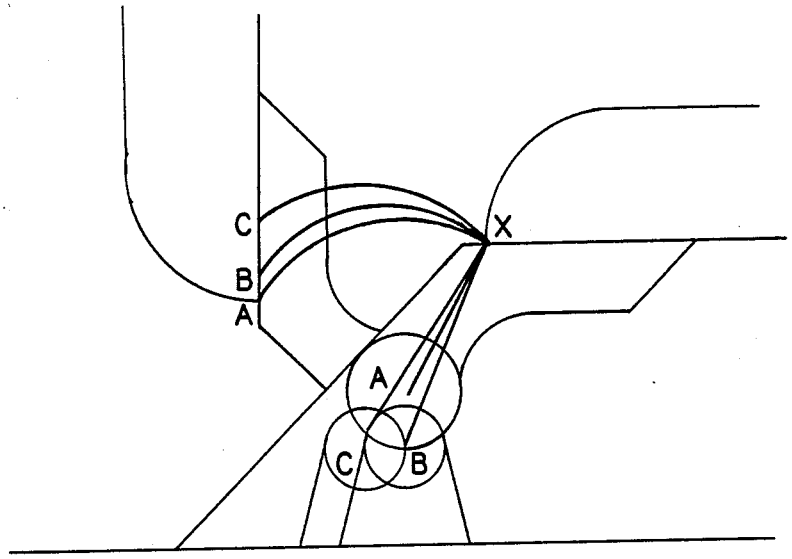
FIG. 6 is a series of symbolic elevations to demonstrate the role of the unique hinge and sliding interlock.

Referring to FIG. 6

Illustrates symbolically the critical role of the hinged and sliding interlock technique used to interconnect the toilet lid to the lid-descent control mechanism.

FIG. 6 displays the fact that a retrofit assembly, if not aligned and/or with legs of unequal length, will bind and become inoperable, i.e.:

Point X, the contact point between existing toilet hinge and lid in the horizontal mode, can be made identical for the invention by simply attaching the invention leg to the same point, i.e. B–X or C–X. But when the lid is raised and the hinge and the invention rotate around different axes, with legs of different lengths, the point X becomes points A, B, and C. Since the lid is not rubber the mechanism will bind. The sliding interlock 9 in FIG. 1 surmounts this unsurmountable obstacle.

Figure 6B:
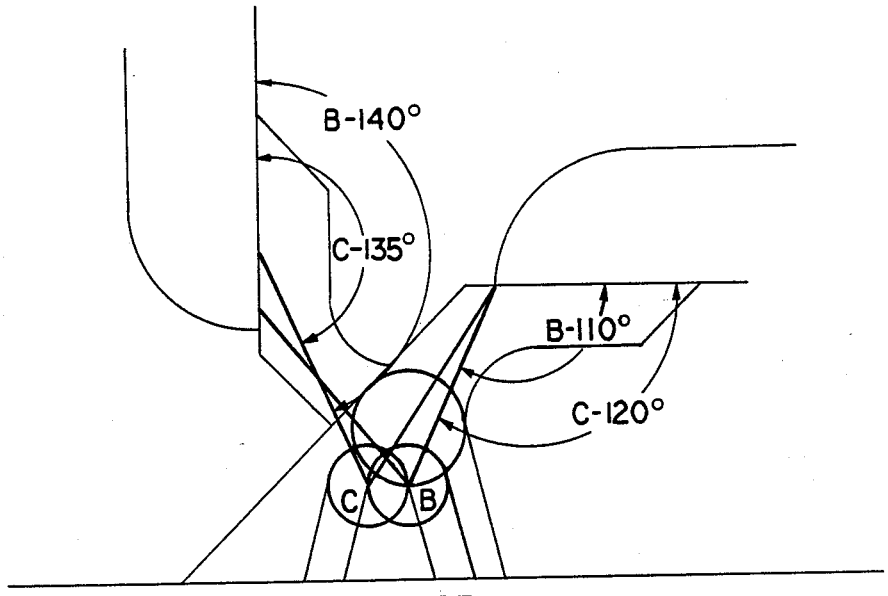

Moreover, in FIG. 6B, we see that the angle of attack between invention hinge leg and lid in the horizontal is always different than the vertical. An inflexible mounting device at X would bind the lid. The hinged union 7 in FIG. 1 enables the invention to work with unequal legs and centers.

The two techniques must be, and are, used in tandem by this invention to enable simple application to unequal legs and centers, which is critical to a layman's retrofit.

Figure 7:
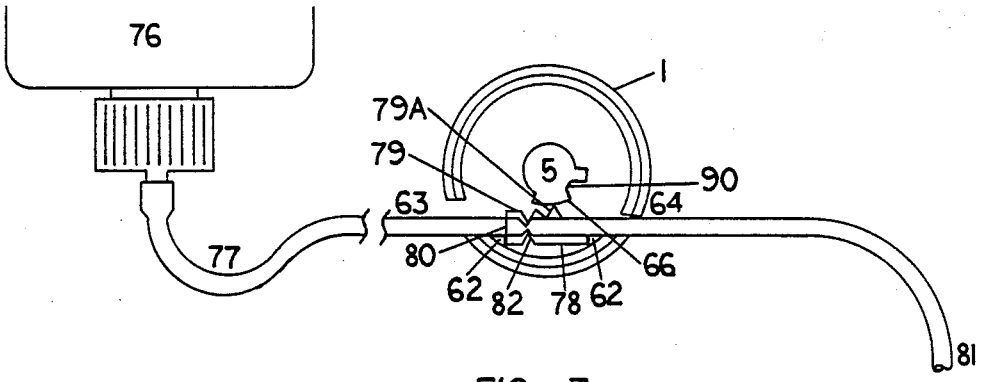
FIG. 7 is a cross-section elevation of the optional toilet bowl cleaner fluid dispenser, to wit, flask, tube and tube clamp, operated by permanent cam on lid control shaft.

Referring to FIG. 7

Toilet bowl cleaner fluid flask 76 is attached to toilet tank or similar position such that fluid may flow thru tube 77 by gravity or syphon action to the toilet bowl. Tube 77 is inserted thru spring tube clamp 79 at opening 80, transversely thru control cylinder 1, out thru opening 64 across the top of and into the toilet bowl at point 81.

Spring tube clamp is slid along tube 77 thru aperture 63 and pressed into position such that spring leg 78 is compressed at "V" bend 82 and locked securely between the two stops 62. Spring clamp leg 79A is depressed by cam 66 on lid control shaft 5 when the lid is up such that the tube is clamped shut.

When the toilet lid descends to the point that the flushing action has subsided, cam 66 has moved to the left until leg 79A rises into "V" notch 90, at which time the clamping action is relaxed and the fluid flows thru the tube.

When the lid approaches the totally closed position the cam again presses the clamp closed until the next flushing cycle.

Figure 8:
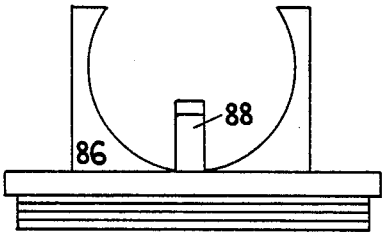
FIG. 8 is an elevation of the saddle attachment assembly of the optional deodorant dispenser.

Referring to FIG. 8

Figure 9:
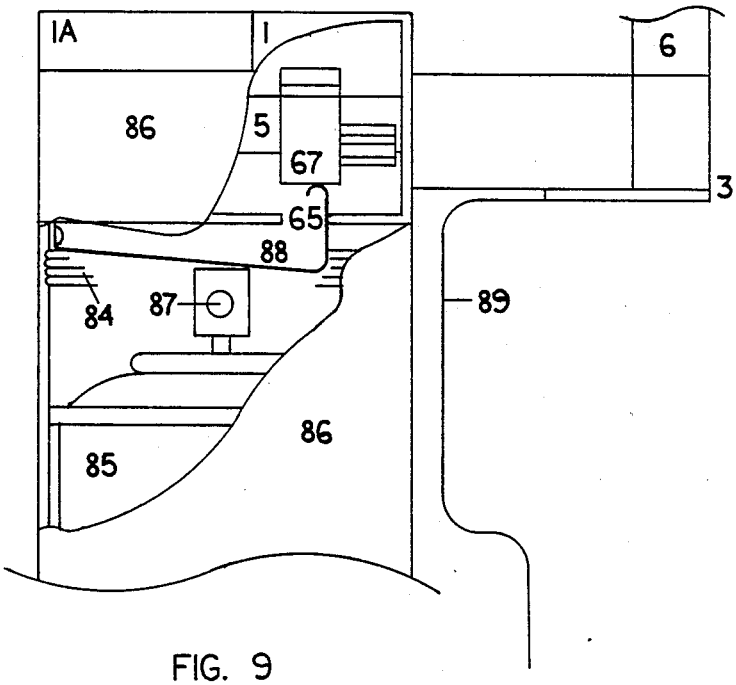
FIG. 9 is an elevation of the optional deodorant-/disinfectant dispenser spray can holder cannister with operating spring and cam mechanism.

Spring lever 88 is depressed down to a flush position and the saddle assembly 86 slid onto control cylinder 1/1A until spring level 88 finds opening 65 in bottom of cylinder, shown in FIG. 9.

Referring to FIG. 9

Spring lever 88 flexes up thru opening 65 to press hard against lid control shaft 5. A spray can of commercial deodorant or disinfectant 85 is placed in cannister 86 which is then screwed up onto the threaded connection 84 of the saddle assembly. The nozzle of the spray can 87 is immediately under spring lever 88.

As the toilet lid descends, rotating arm 6 around shaft 5, cam 67 on shaft 5 depresses spring lever 88 momentarily, which in turn depresses the spray can nozzle 87 momentarily, dispensing deodorant or disinfectant thru a opening (not shown) in the cannister wall into the room atmosphere.

While the preceding description and the associated illustrations focus on the preferred retrofit form of the invention, it is quite possible to vary or modify the device substantially without departing from the spirit and scope of the invention. I intend that my invention extends to all such variations or modifications as come within the spirit and scope of the following claims, particularly the integration of the invention directly into toilet lid/seat assemblies or lid/seat hinge assemblies, and to other fluid, mechanical or electrical means of accomplishing the same end as the claims, individually or in toto.

I claim:

1. In a toilet apparatus for use with domestic toilets, the combination of a horizontal cylindrical housing slidably attached to a mounting assembly adapted to be secured to the toilet bowl, said housing comprising a liquid filled chamber defined by a first side wall bound by first and second end walls of said housing, said chamber including a pressure barrier wall sealingly secured to said end walls and along a length of said side wall, said pressure barrier wall extending radially inward between said side wall and the longitudinal axis of said housing; a lid control shaft sealingly and rotatably attached to said first end wall and extending along said longitudinal axis through an aperture in said second end wall terminating in a free end portion of said shaft, said shaft being in sealing engagement with said pressure barrier wall and including sealing means for sealing engagement with said second end wall, said shaft further including a liquid flow inhibitor blade extending radially from said shaft and in sealing engagement with said end walls and said side wall, said blade being fitted with a bleed port and a check valve, said free end portion of said shaft having cam means mounted thereto for operating toilet bowl disinfecting and deodorizing means; a hinged arm having a first end portion slidably secured to a mounting bracket adapted to be secured to the toilet lid, and a second end portion fixedly attached to the free end portion of said shaft whereby said shaft is rotated in a first direction when the lid is raised to a substantially vertical position; initiator spring means mounted in said liquid chamber and biasing said blade in a second opposite direction; and, operating means connected between the cam means and the toilet flush handle for holding the lid in the substantially vertical position prior to the flush handle being actuated, and causing said initiator spring means to initiate rotation of the shaft in said second direction when the flush handle is actuated causing the lid to descend by gravitational force toward the toilet bowl being dampened by inhibited liquid flow through said bleed port of said blade, and further said cam means simultaneously operates said toilet bowl disinfecting and deodorizing means.

2. An apparatus as recited in claim 1, wherein a lid descent-rate adjustment means comprises a transverse port through rail shaft proximate said first end wall, said port interrupted by a needle valve threaded through the first end wall of the liquid chamber and into the center of the shaft.

3. An apparatus as recited in claim 2, wherein a lid descent-rate override comprises a port through the fixed pressure barrier wall fitted with a high pressure relief flap.

4. An apparatus as recited in claim 3, wherein said initiator spring means comprises a ninety-degree shaped spring housing one leg fixedly attached vertically to the fixed barrier wall, and the other leg bent over the shaft and engaging the blade thereby biasing the shaft to initiate rotation of the toiled lid in said second direction.

5. An apparatus as recited in claim 4, wherein said housing further comprises a second chamber defined by a second side wall and a third end wall, said second chamber having an open end releasably secured to said second end wall of the liquid chamber to form said housing, said free end portion of the shaft having an enclosed portion extending through said second chamber and an exposed portion extending out through an aperture in said third end wall; said hinged arm is attached at said second end portion thereof to said exposed portion of the shaft; said cam means is mounted to said enclosed portion of the shaft and comprises a post; and, said operating means comprises a two-leg spring attached to said second end wall within the second chamber, and a vertical rod, the first of said spring legs selectively engages said post and the other leg extends through an opening in said second side wall and is connected to one end of said rod, said operating means further comprising means for connecting the other end of said rod to the flush handle such that said first spring leg engages said post when the lid is raised to hold the lid in the substantially vertical position and disengages said post when the flush handle in actuated allowing the initiator spring to initiate the lid descent.

6. An apparatus as recited in claim 5, wherein said hinged arm comprises a channel having inwardly disposed flanges formed in said first end portion of the arm and said toilet lid mounting bracket comprises a rib slidably received in said channel; said second end portion of the arm having a sleeve portion fixedly attached to said exposed shaft portion, and a straight portion having one end fixedly attached to and extending tangentially from said sleeve portion; and, said first end portion of the arm is hingedly secured to the other end of said straight portion of the arm whereby when the toilet lid is pivoted the lid mounting bracket translates with respect to the arm to compensate for misalignment of the lid pivot axis and the shaft axis.

7. An apparatus as recited in claim 5, wherein a gravity feed toilet bowl disinfectant dispenser comprises a replaceable liquid-filled flask adapted to be mounted to the exterior of the toilet tank; a tube connected to the bottom of the flask and extending transversely through two openings in the toilet bowl; spring clamp means mounted in said second chamber to open and close the flow of liquid through said tube; and, said cam means further comprises a cam which selectively engages said spring clamp means, whereby when the shaft is rotated during pivoting of the toilet lid, said cam simultaneously opens and closes the flow of liquid to the toilet bowl.

8. An apparatus as recited in claim 5, wherein an air deodorizer dispenser comprises a deodorizer mounting bracket releasably secured to said housing; a cannister holder releasably secured to said deodorizer mounting bracket and adapted to hold a deodorant aerosol can in an upright position; spring depresser means mounted to said deodorizer mounting bracket and extending through an opening in the bottom of said second chamber for selectively opening the valve on the top of the aerosol can; and, said cam means further comprises a cam which selectively engages said spring depresser means, whereby when the shaft is rotated during pivoting of the toilet lid, said cam simultaneously opens the aerosol can valve thereby admitting deodorant to the air.

9. An apparatus as recited in claim 1, wherein said lid mounting bracket further comprises a female latch adjustably mounted thereto which receives a male spring latch adapted to be mounted to the toilet seat, whereby the toilet seat is selectively latched to the toilet lid thereby pivoting therewith as a unit, and the toilet seat is released from the toilet lid when the unit is caused to descend upon actuation of the flush handle causing said male spring latch to engage the toilet bowl thereby being biased under the weight of the unit to unlatch said male and female latches.

10. An apparatus as recited in claim 1, wherein a toilet lid lock comprises a locking arm and a spring pivotably mounted on the cylinder mounting assembly, said locking member biased by said spring into position against a stop mounted on said second end portion of the hinged arm when the toilet lid is in a down position thereby preventing the lid from being raised until the lock is manually released.

* * * * *